US010455931B2

(12) United States Patent
Jimenez et al.

(10) Patent No.: US 10,455,931 B2
(45) Date of Patent: Oct. 29, 2019

(54) ORAL CARE IMPLEMENT

(71) Applicant: Colgate-Palmolive Company, New York, NY (US)

(72) Inventors: Eduardo Jimenez, Manalapan, NJ (US); Joachim Storz, Zell am See (AT); Andreas Wechsler, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 210 days.

(21) Appl. No.: 15/539,399

(22) PCT Filed: Dec. 23, 2014

(86) PCT No.: PCT/US2014/072066

§ 371 (c)(1),
(2) Date: Jun. 23, 2017

(87) PCT Pub. No.: WO2016/105369

PCT Pub. Date: Jun. 30, 2016

(65) Prior Publication Data

US 2017/0367473 A1 Dec. 28, 2017

(51) Int. Cl.
*A46B 15/00* (2006.01)
*A46B 9/04* (2006.01)

(52) U.S. Cl.
CPC ..... *A46B 15/0081* (2013.01); *A46B 9/04* (2013.01); *A46B 2200/1066* (2013.01)

(58) Field of Classification Search
CPC ..... A46B 15/0081; A46B 2200/1066; A46B 9/04
See application file for complete search history.

(56) References Cited

U.S. PATENT DOCUMENTS

| | | | |
|---|---|---|---|
| 758,764 | A | 5/1904 | MacLeod |
| 846,900 | A | 3/1907 | Bloom |
| 1,125,532 | A | 1/1915 | Himmel |
| 1,901,230 | A | 3/1933 | Palmer |

(Continued)

FOREIGN PATENT DOCUMENTS

| | | |
|---|---|---|
| AR | 71556 | 10/2003 |
| AR | 80042 | 11/2009 |

(Continued)

OTHER PUBLICATIONS

International Search Report and the Written Opinion issued in International Application PCT/US2010/046806 dated Mar. 16, 2011.

(Continued)

*Primary Examiner* — Marc Carlson

(57) ABSTRACT

An oral care implement including an elastomeric component that includes a bumper portion that forms a distal-most section of the peripheral surface and a wall portion located along a distal-most section of the perimeter edge and protruding above the front surface. The wall portion may include a first ramped portion, an apex portion, and a second ramped portion. The wall portion may include a plurality of spaced-apart ridges protruding from an outer surface of the bumper portion and an outer surface of the wall portion. An oral care implement is disclosed that includes a soft tissue cleanser having a plurality of protuberances of differing heights.

19 Claims, 9 Drawing Sheets

(56) References Cited

U.S. PATENT DOCUMENTS 1,924,152 A 8/1933 Coney et al.
2,161,349 A 6/1939 Hadden
2,186,005 A 1/1940 Casto
2,305,461 A 12/1942 Spyra
D273,635 S 5/1984 Stocchi
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A 9/1998 Dawson et al.
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A 10/1999 Inns et al.
5,984,935 A 11/1999 Budei et al.
5,991,958 A 11/1999 Hohlbein
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,234,798 B1 5/2001 Salazar et al.
6,276,021 B1 8/2001 Hohlbein
6,292,973 B1 9/2001 Moskovich et al.
D450,457 S 11/2001 Hohlbein
D450,929 S 11/2001 Angelini et al.
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S * 4/2005 Desalvo ..... D4/104
6,886,207 B1 5/2005 Solanki
6,889,405 B2 5/2005 Ritrovato et al.
6,895,629 B1 * 5/2005 Wenzler ..... A46B 15/0055 15/106
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 * 1/2009 Hohlbein ..... A46B 9/028 15/111
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.
D623,415 S 9/2010 Geiberger
7,788,756 B2 9/2010 Kraemer
7,845,042 B2 12/2010 Moskovich et al.
7,854,036 B2 12/2010 Georgi
7,930,792 B2 4/2011 Russell
7,937,794 B2 5/2011 Huber et al.
7,954,191 B2 6/2011 Hohlbein
7,958,589 B2 6/2011 Braun et al.
7,975,343 B2 7/2011 Hohlbein et al.
7,975,346 B2 7/2011 Moskovch et al.
7,979,947 B2 7/2011 Storkel et al.
8,032,991 B2 10/2011 Lawless
8,042,217 B2 10/2011 Sorrentino

(56) References Cited

U.S. PATENT DOCUMENTS 8,046,864 B2 11/2011 Baertschi et al.
8,060,972 B2 11/2011 Geiberger et al.
8,083,980 B2 12/2011 Huber et al.
8,239,996 B2 8/2012 Garber et al.
8,307,488 B2 11/2012 Pfenniger et al.
8,327,492 B2 12/2012 Cann
8,332,982 B2 12/2012 Braun et al.
8,332,985 B2 12/2012 Solanki
8,382,208 B2 2/2013 Baertschi et al.
8,448,284 B2 5/2013 Gross et al.
8,448,287 B2 5/2013 Ponzini et al.
8,458,846 B2 6/2013 Schamberg et al.
8,484,789 B2 7/2013 Claire-Zimmet et al.
8,500,766 B2 8/2013 Jimenez et al.
8,528,148 B2 9/2013 Brown, Jr. et al.
8,595,886 B2 12/2013 Edelstein et al.
8,601,635 B2 12/2013 Goldman et al.
8,608,251 B2 12/2013 Nirwing et al.
8,621,698 B2 1/2014 Chenvainu et al.
8,631,534 B2 1/2014 Blanchard et al.
8,732,890 B2 5/2014 Mohr et al.
8,739,351 B2 6/2014 Kling et al.
8,776,302 B2 7/2014 Baertschi et al.
8,813,292 B2 8/2014 Driesen et al.
9,398,802 B2 * 7/2016 Moskovich ..... A46B 9/06
9,681,740 B2 * 6/2017 Lee ..... A46B 5/0029
2002/0017003 A1 2/2002 Kramer et al.
2002/0138928 A1 10/2002 Calabrese
2003/0077107 A1 * 4/2003 Kuo ..... A46B 15/0002 401/278
2003/0163881 A1 9/2003 Driesen et al.
2003/0178745 A1 9/2003 Scarabelli et al.
2003/0178885 A1 9/2003 Weihrauch
2004/0025275 A1 2/2004 Moskovich et al.
2004/0107521 A1 6/2004 Chan et al.
2004/0134007 A1 7/2004 Davies
2005/0166343 A1 8/2005 Gavney, Jr.
2005/0210612 A1 * 9/2005 Hohlbein ..... A46B 9/04 15/110
2006/0048314 A1 3/2006 Kressner
2006/0048323 A1 3/2006 Rueb
2006/0064827 A1 3/2006 Chan
2006/0123574 A1 6/2006 Storkel et al.
2006/0200925 A1 * 9/2006 Moskovich ..... A46B 5/0029 15/167.1
2006/0236477 A1 10/2006 Gavney, Jr.
2006/0236478 A1 10/2006 Hohlbein et al.
2006/0248667 A1 11/2006 Kraemer
2007/0151058 A1 7/2007 Kraemer et al.
2007/0169295 A1 7/2007 Winter et al.
2007/0265555 A1 11/2007 Deng
2007/0283517 A1 12/2007 Blanchard et al.
2007/0283518 A1 * 12/2007 Blanchard ..... A46B 9/025 15/167.1
2008/0201884 A1 * 8/2008 Vazquez ..... A46B 9/04 15/167.1
2009/0007357 A1 1/2009 Meadows et al.
2009/0038097 A1 2/2009 Geiberger
2009/0158543 A1 6/2009 Lee
2009/0255077 A1 10/2009 Mori et al.
2010/0043162 A1 2/2010 Kling et al.
2010/0058550 A1 3/2010 Ballmaier et al.
2010/0088836 A1 4/2010 Kirchhofer et al.
2010/0101037 A1 4/2010 Hilfiker et al.
2010/0115724 A1 5/2010 Huang
2010/0180392 A1 7/2010 Binet et al.
2010/0223746 A1 9/2010 Mueller
2010/0263149 A1 10/2010 Ballmaier et al.
2010/0306941 A1 12/2010 Erskine-Smith et al.
2011/0030160 A1 2/2011 Knutzen et al.
2011/0047736 A1 3/2011 Jimenez et al.
2011/0138560 A1 6/2011 Vitt et al.
2011/0152909 A1 * 6/2011 Jimenez ..... A61B 17/244 606/161
2011/0219558 A1 9/2011 Vitt et al.
2011/0109149 A1 12/2011 Loetscher et al.
2012/0034576 A1 2/2012 Mostafa
2012/0192369 A1 8/2012 Mohr et al.
2013/0007968 A1 1/2013 Driesen et al.
2013/0036566 A1 2/2013 Schlatter
2013/0139338 A1 6/2013 Hess et al.
2013/0255017 A1 * 10/2013 Lee ..... A46B 3/22 15/105
2013/0269128 A1 10/2013 Jimenez
2013/0291320 A1 11/2013 Kirchhofer et al.
2013/0333126 A1 12/2013 Miller
2014/0047656 A1 2/2014 Newman et al.
2014/0158152 A1 6/2014 Kirchhofer et al.
2014/0173838 A1 6/2014 Dickie et al.
2014/0173853 A1 6/2014 Kirchhofer et al.
2014/0298605 A1 10/2014 Ivory
2014/0310901 A1 10/2014 Geiberger et al.

FOREIGN PATENT DOCUMENTS

BR 7900283 8/2000
BR DI 6601454-9 4/2006
BR DI 6702593 8/2007
BR DI 6805210-3 11/2008
BR DI 6902120-1 5/2009
BR DI 6903329-3 8/2009
BR DI 6903330-7 8/2009
BR DI 6904386 11/2009
BR DI 7102178-7 4/2011
BR 30 2013 000448-1 2/2013
BR DI 6401609-9 5/2014
CH 215110 6/1941
CN 3372860D 6/2004
CN 3372861D 6/2004
CN 2732059 10/2005
CN 300704339 10/2007
CN 201157105 12/2008
CN 201294969 8/2009
CN 201518876 7/2010
CN 201518877 7/2010
CN 201518880 7/2010
CN 201528796 7/2010
CN 201541995 8/2010
CN 201541996 8/2010
CN 201541997 8/2010
CN 201550827 8/2010
CN 301406316 S 12/2010
CN 301421505 S 12/2010
CN 201814085 5/2011
CN 201986933 9/2011
CN 301763519 12/2011
CN 30198826 5/2012
CN 302058056 9/2012
CN 302225957 S 12/2012
CN 302328863 S 2/2013
CN 202800555 3/2013
CN 103005839 4/2013
CN 203194906 9/2013
CN 203220069 10/2013
CN 203220073 10/2013
CN 203252150 10/2013
CN 302956580 S 10/2014
DE 19858102 6/2000
DE 202005009026 10/2005
DE 102006016939 5/2007
DE 102006005616 8/2007
DE 102006024874 11/2007
DE 202008016004 2/2009
EM 000366984-0001 7/2005
EM 000638028-0002 12/2006
EM 001975079-0005 1/2012
EM 002163675-0002 1/2013
EM 002163675-0003 1/2013
EM 002212522-0004 4/2013
EM 002212522-0012 4/2013
EM 002424069-0001 3/2014
EP 0716821 6/1996
EP 0769920 9/2003

(56) References Cited

FOREIGN PATENT DOCUMENTS

| | | |
|---|---|---|
| EP | 2810581 | 12/2014 |
| ES | 1063617 | 11/2006 |
| IT | 2010PDO000035-0019 | 10/2010 |
| JP | H08164025 | 6/1996 |
| JP | 10042957 | 8/1996 |
| JP | D1314270 | 10/2007 |
| JP | 2014087475 | 5/2014 |
| KR | 20040032038 | 4/2004 |
| KR | 838174 | 6/2007 |
| KR | 20-2012-0005449 | 7/2012 |
| MX | 32553 | 11/2009 |
| MX | 36113 | 4/2011 |
| MX | 36650 | 4/2011 |
| RU | 55985 | 1/2005 |
| RU | 79787 | 10/2011 |
| RU | 80086 | 11/2011 |
| RU | 81915 | 6/2012 |
| WO | WO1995/06420 | 3/1995 |
| WO | WO1995/10959 | 4/1995 |
| WO | WO1999/023910 | 5/1999 |
| WO | WO1999/55514 | 11/1999 |
| WO | WO1999/65358 | 12/1999 |
| WO | WO2000/49911 | 8/2000 |
| WO | WO2001/17392 | 3/2001 |
| WO | WO2001/29128 | 4/2001 |
| WO | WO2001/45573 | 6/2001 |
| WO | WO2001/182741 | 11/2001 |
| WO | WO2004/043669 | 5/2004 |
| WO | WO2005/122827 | 12/2005 |
| WO | WO2008/017996 | 2/2008 |
| WO | WO2011/070549 | 6/2011 |
| WO | WO2012/017923 | 2/2012 |
| WO | WO2012/115035 | 8/2012 |
| WO | WO2012/176741 | 12/2012 |
| WO | WO2013/031685 | 3/2013 |

OTHER PUBLICATIONS

International Search Report and the Written Opinion issued in International Application PCT/US2012/070760 dated Oct. 14, 2013.

International Search Report and the Written Opinion issued in International Application PCT/US2014/072066 dated Nov. 3, 2015.

* cited by examiner

ORAL CARE IMPLEMENT

BACKGROUND

A major source of bad breath in healthy people is microbial deposits on the tongue, where a bacterial coating harbors organisms and debris that contribute to bad breath. While oral care implements containing tongue scrapers have been used in the past in order to remove bacteria from the tongue, these oral care implements are inadequate in respect to their effectiveness on the soft tissue surface of the tongue. These oral care implements are also limited in that the tissue cleanser is provided only on one major surface of the head and tend to be small in size and can be ineffective in scraping debris off of the tongue. These oral care implements are further limited in that the oral care implement provides inadequate comfort when contacting the surface of a user's gums during cleaning.

BRIEF SUMMARY

Exemplary embodiments according to the present disclosure are directed to an oral care implement that includes an elastomeric component that includes a bumper portion that forms a distal-most section of the peripheral surface and a wall portion located along a distal-most section of the perimeter edge and protruding above the front surface. The wall portion may comprise a first ramped portion, an apex portion, and a second ramped portion in certain embodiments. The wall portion may include a plurality of spaced-apart ridges protruding from an outer surface of the bumper portion and an outer surface of the wall portion in certain embodiments, In still other embodiments, an oral care implement is disclosed that includes a soft tissue cleanser having a plurality of protuberances of differing heights.

In one aspect, the invention can be an oral care implement comprising: a handle and a head extending along a longitudinal axis from a proximal end to a distal end; the head comprising: a front surface, a rear surface opposite the front surface, a peripheral surface extending between the front and rear surfaces and defining a perimeter edge of the front surface, a plurality of tooth cleaning elements extending from the front surface, an elastomeric component including a bumper portion that forms a distal-most section of the peripheral surface and a wall portion located along a distal-most section of the perimeter edge and protruding above the front surface, the wall portion extending along the perimeter edge in a continuous manner from a first point of the perimeter edge to a second point of the perimeter edge, the first and second points located on opposite sides of the longitudinal axis, the wall portion comprises a first ramped portion, an apex portion, and a second ramped portion, the apex portion disposed between the first and second ramped portions.

In another aspect, the invention can be an oral care implement comprising: a handle and a head extending along a longitudinal axis from a proximal end to a distal end, the head comprising: a front surface, a rear surface opposite the front surface, a peripheral surface extending between the front and rear surfaces and defining a perimeter edge of the front face, a plurality of tooth cleaning elements extending from the front surface, an integrally formed elastomeric component including: a bumper portion that forms a distal-most section of the peripheral surface, a wall portion located along a distal-most section of the perimeter edge and protruding above the front surface, a plurality of spaced-apart ridges protruding from an outer surface of the bumper portion and an outer surface of the wall portion, and a soft tissue cleanser on the rear surface of the head, the soft tissue cleanser comprising a plurality of protuberances.

In yet another aspect, the invention can be an oral care implement comprising: a handle and a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of first protuberances protruding from the rear surface of the head and arranged in a first annular zone on the rear surface, each of the first plurality of protuberances having a height between a first predetermined height and a second predetermined height, the second predetermined height being greater than the first predetermined height, a plurality of second protuberances protruding from the rear surface of the head and arranged in a second annular zone on the rear surface, the first annular zone surrounding the second annular zone, each of the second plurality of protuberances having a height between the second predetermined height and a third predetermined height, the third predetermined height being greater than the second predetermined height; and a plurality of third protuberances protruding from the rear surface of the head and arranged in a third zone on the rear surface, the second annular zone surrounding the third zone, each of the third plurality of protuberances having a height between the third predetermined height and a fourth predetermined height, the fourth predetermined height being greater than the third predetermined height.

In still another aspect, the invention can be an oral care implement comprising: a handle, a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of cylindrical nubs protruding from the rear surface of the head, wherein free ends of the plurality of protuberances collectively form a convex side profile and a convex top profile.

In a further aspect, the invention can be an oral care implement comprising: a handle and a head extending along a longitudinal axis from a proximal end to a distal end, the head comprising: a front surface, a rear surface, a plurality of tooth cleaning elements extending from the front surface, and a soft tissue cleanser on the rear surface of the head; the soft tissue cleanser comprising: a plurality of first protuberances protruding from the rear surface of the head, each of the first plurality of protuberances having a height between a first predetermined height and a second predetermined height, the second predetermined height being greater than the first predetermined height; a plurality of second protuberances protruding from the rear surface of the head, each of the second plurality of protuberances having a height between the second predetermined height and a third predetermined height, the third predetermined height being greater than the second predetermined height; and a plurality of third protuberances protruding from the rear surface of the head, each of the third plurality of protuberances having a height between the third predetermined height and a fourth predetermined height, the fourth predetermined height being greater than the third predetermined height.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
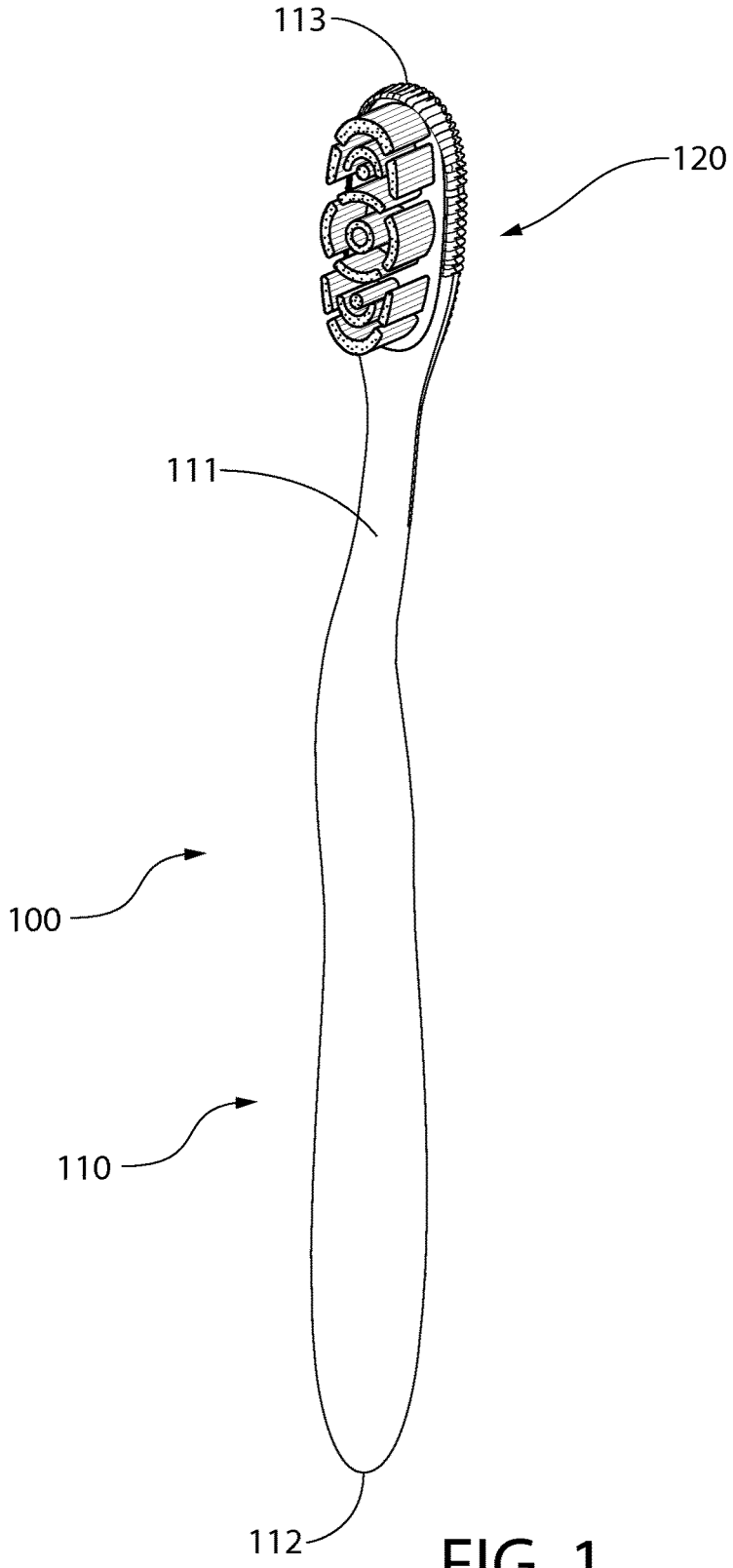
FIG. 1 is a front perspective view of an oral care implement according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

In the following description, the invention is discussed in terms of a manual toothbrush. However, in other forms, the invention could be in the form of other oral care implements including a soft-tissue cleansing implement, a powered toothbrush, a refill head, or other ansate implements designed for oral care.

Referring first to FIG. 1, an oral care implement 100 is illustrated according to one embodiment of the present invention. The oral care implement 100 generally comprises a handle 110 and a head 120. The handle 110 provides the user with a mechanism by which he/she can readily grip and manipulate the oral care implement 100. The handle 110 is generically illustrated and may be formed of many different shapes, sizes, materials and by a variety of manufacturing methods that are well-known to those skilled in the art. For example, the handle 110 can be constructed of elastomers, polypropylene, SAN, ABS, or even paper products such as a typical lollipop stick. If desired, the handle 110 may include a suitable textured grip (not shown) made of a thermoplastic elastomer or can be a multi-part construction. The details of the handle 110 are not limiting of the present invention and, thus, require no further discussion for purposes of the present invention.

The oral care implement 100 extends from a proximal end 112 to a distal end 113. The head 120 is operably connected to a distal end of the handle 110. Generally, the head 110 and the handle 120 of the toothbrush are preferably formed as a single unitary structure using a molding, milling, machining or other suitable process. However, in other embodiments, the handle 110 and head 120 may be formed as separate components which are operably connected at a later stage of the manufacturing process by any suitable technique known in the art, including without limitation thermal welding, a tight-fit assembly, a coupling sleeve, adhesion, or fasteners. Whether the head 120 and handle 110 are of a unitary or multi-piece construction (including connection techniques) is not limiting of the present invention unless specifically stated in the claims.

Figure 2:
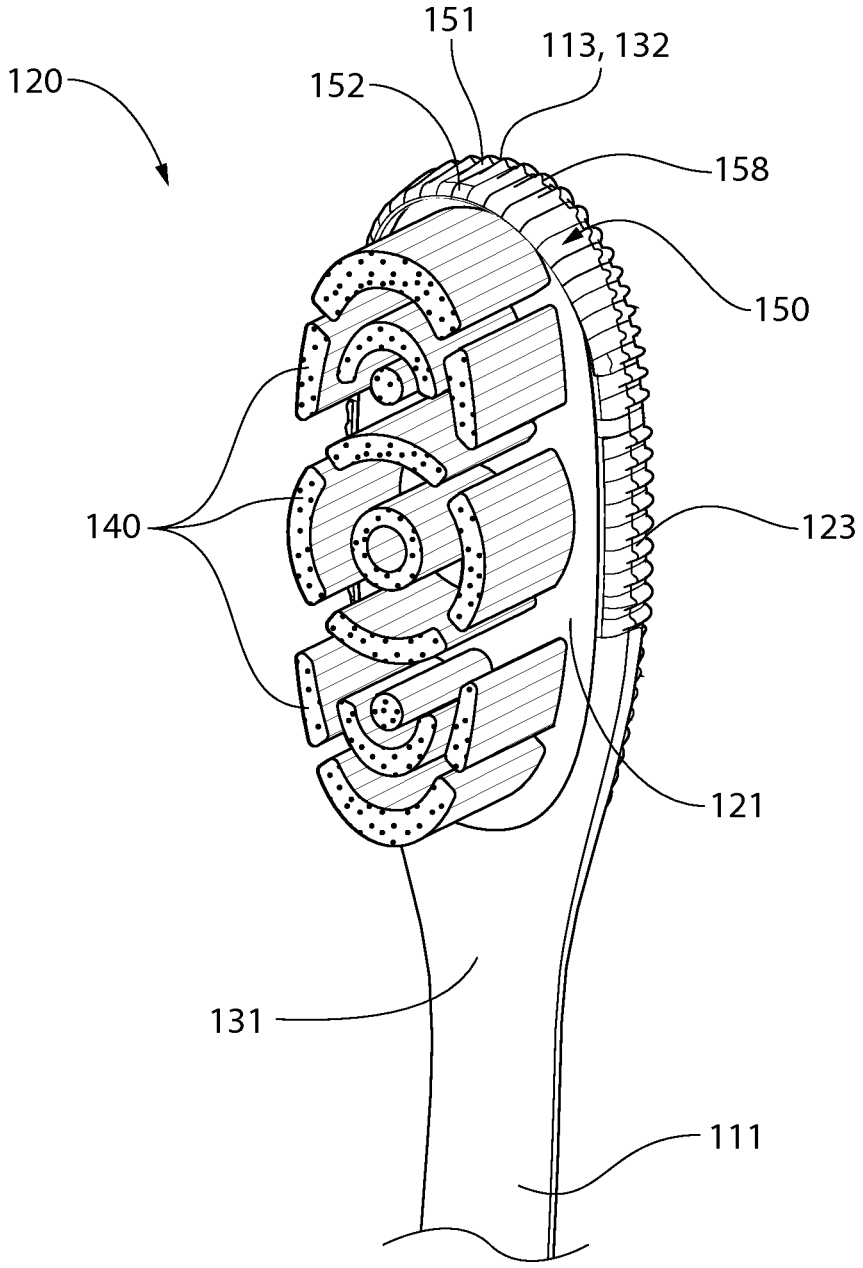
FIG. 2 is a close-up view of the head of the oral care implement of FIG. 1.
Figure 3:
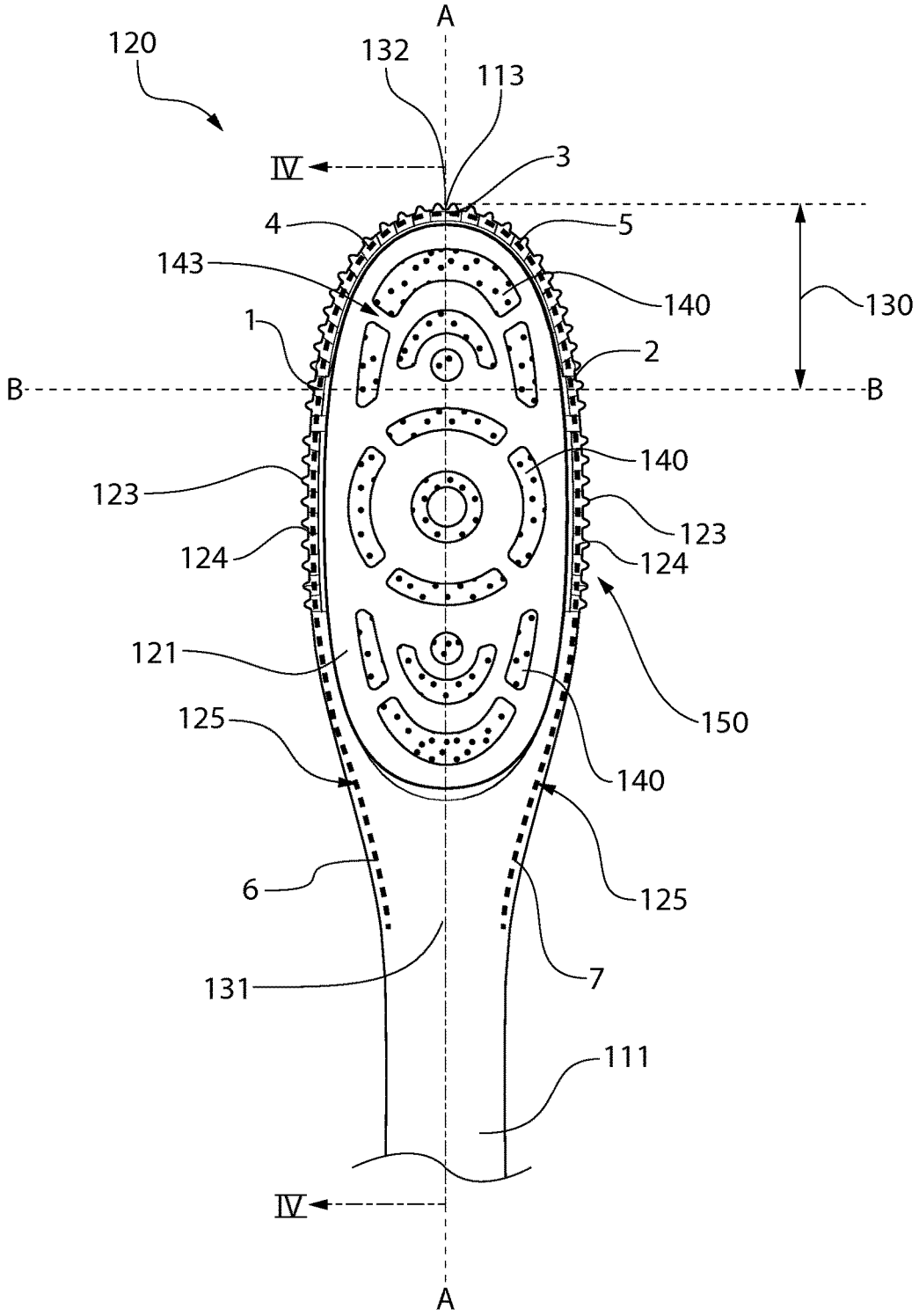
FIG. 3 is a front view of the head of the oral care implement of FIG. 1.
Figure 4:
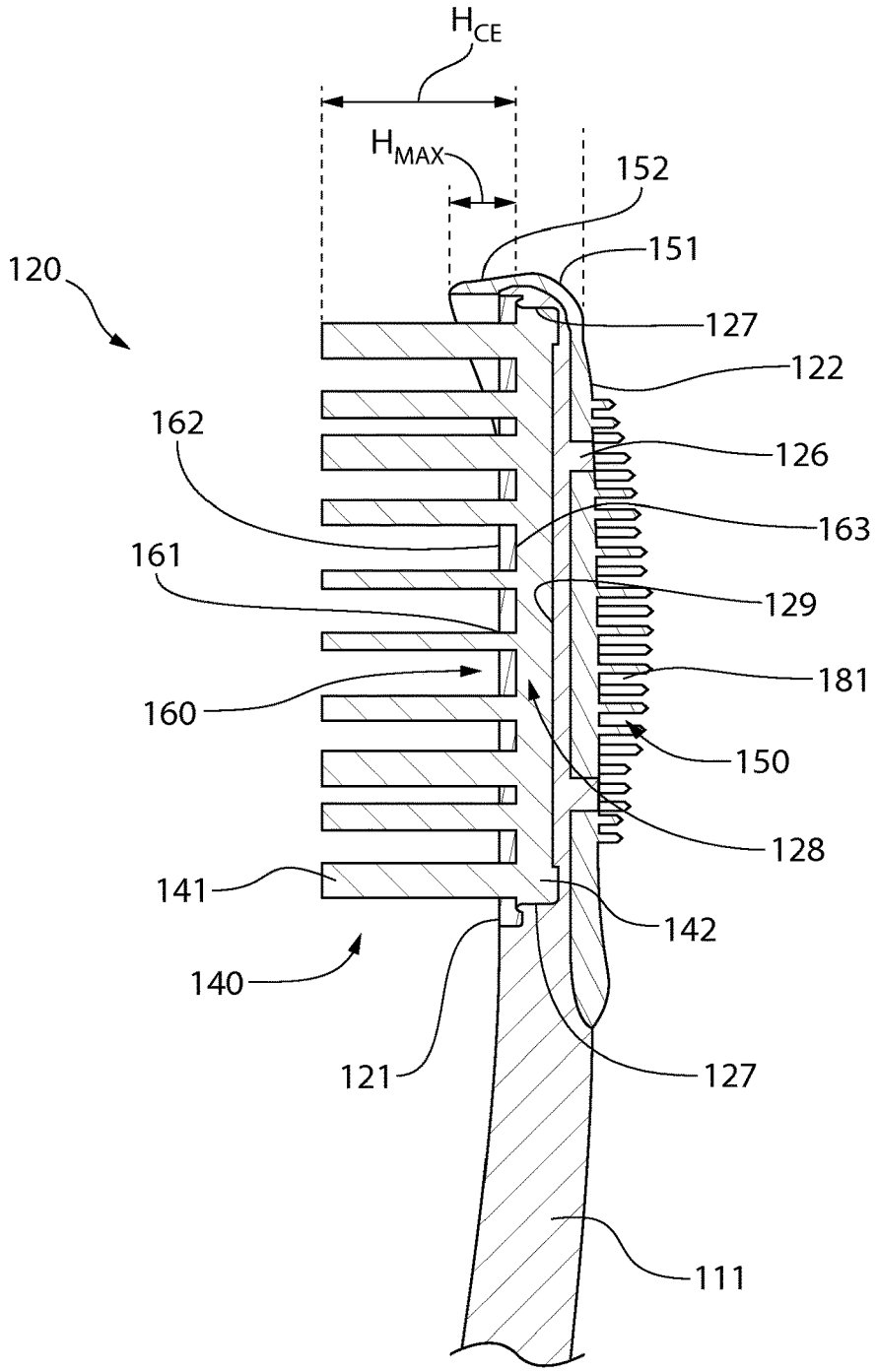
FIG. 4 is a longitudinal cross-sectional view of the head of the oral care implement of FIG. 1 along view IV-IV of FIG. 3.

It should be noted at this time that relative terms such as distal, middle, proximal, upper, lower, top, bottom, left, right etc. are merely used to delineate relative positions of the components of the oral care implement 100 with respect to one another and are not intended to be in any further way limiting of the present invention Referring to FIGS. 2 and 3, the head 120 extends along a longitudinal axis A-A from a proximal end 131 of the head 120 to a distal end 132 of the head 120. The head 120 generally comprises a front surface 121, a rear surface 122 that is opposite the front surface 121 (as shown in FIG. 4) and a peripheral surface 123. The peripheral surface 123 extends between the front surface 121 and the rear surface 122, connecting the front and rear surfaces 121, 122 and defining a perimeter edge 124 of the front surface 121. The front surface 121, the rear surface 122, and the peripheral surface 123 of the head 120 can take on a wide variety of shapes and contours, none of which are limiting of the present invention. For example, the surfaces can be planar, contoured or combinations thereof. Furthermore, while the head 120 is normally widened relative to the neck 111 of the handle 110, it could in some constructions simply be a continuous extension or narrowing of the handle 110.

Referring to FIGS. 3-6 concurrently, the head 120 further comprises an elastomeric component 150, which may include a bumper portion 151 that forms a distal-most section 130 of the peripheral surface 123 and a wall portion 152 located along a distal-most section of the perimeter edge 124. The wall portion 152 protrudes above the front surface 121. The wall portion 152 extends along the perimeter edge 124 in a continuous manner from a first point 1 of the perimeter edge 124 to a second point 2 of the perimeter edge 124. The first and second points 1, 2 are located on opposite sides of the longitudinal axis A-A. The wall portion 152 may comprise a first ramped portion 153, a second ramped portion 154, and an apex portion 155 (best visible in FIG. 7). The apex portion 155 is disposed between the first ramped position 153 and the second ramped position 154.

In one embodiment, the first ramped portion 153 may extend from the first point 1 to a fourth point 4 of the perimeter edge 124. The fourth point 4 is located between the first and third points 1, 3. The height of the first ramped portion 153 of the wall portion 152 increases from the first point 1 to the fourth point 4. The second ramped portion 154 may extend from the second point 2 to a fifth point 5 of the perimeter edge 124. The fifth point 5 is located between the second and third points 2, 3. The height of the second ramped portion 154 of the wall portion 152 increases from the second point 2 to the fourth point 5. The apex portion 155 may extend from the fourth point 4 to the fifth point 5. The apex portion 155, in the exemplified embodiment, has a substantially constant height from the fourth point 4 to the fifth point 5.

The wall portion 152 has a maximum height $H_{max}$ at the third point 3 of the perimeter edge 124, which is located between the first and second points 1, 2. The third point 3 is located on the longitudinal axis IV and on the apex portion 155. The wall portion 152 has a substantially zero height at the first and second points 1, 2.

In another embodiment, the first ramped portion 153 may extend from the first point 1 to the third point 3, wherein the height of the first ramped portion 153 of the wall portion 152 may increase from the first point 1 to the third point 3. The second ramped portion 154 may extend from the second point 2 to the third point 3, wherein the height of the second ramped portion 154 of the wall portion 152 may increase from the second point 2 to the third point 3. In such an embodiment, the apex portion 155 may take the form of a single point, rather than a section.

Figure 5:
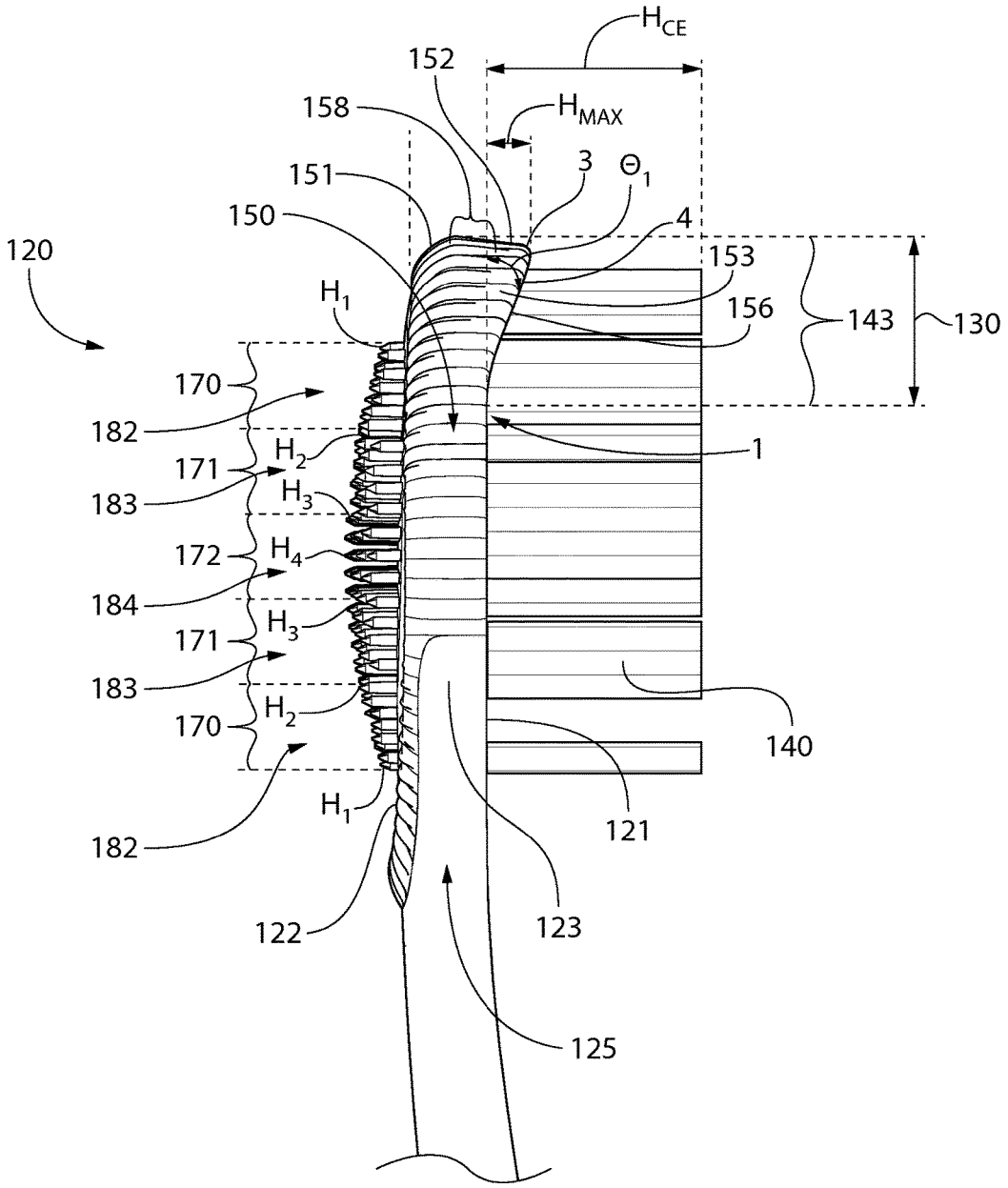
FIG. 5 is a right-side view of the head of the oral care implement of FIG. 1.
Figure 6:
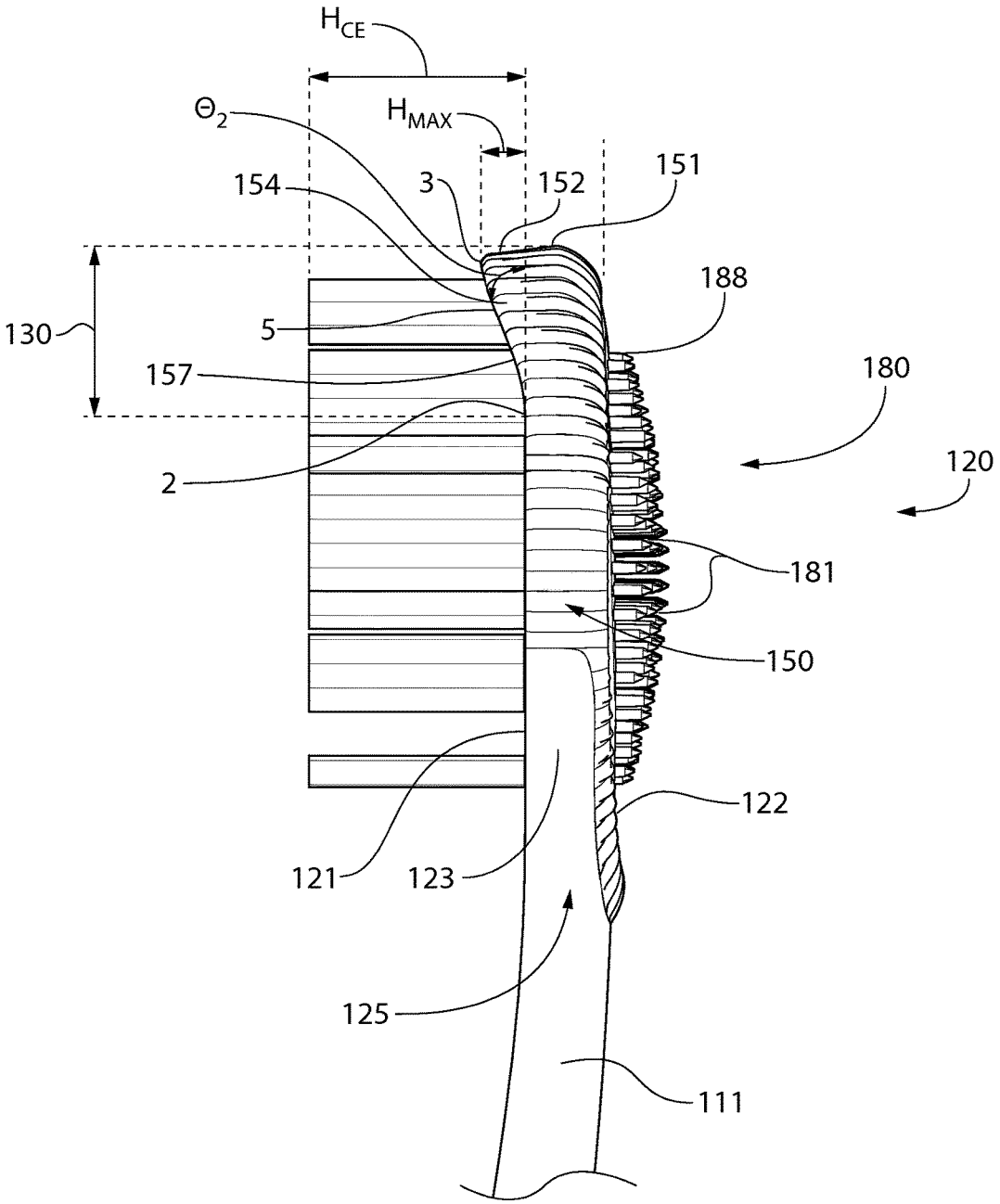
FIG. 6 is a left-side view of the head of the oral care implement of FIG. 1.

The first and second ramped portions 153, 154 may comprise an upper edge 156, 157 that appear as a linear slope when the head is viewed in side profile (see FIGS. 5 and 6). The first upper edge 156 of the first ramped portion 153 may extend upward from the front surface 121 at an angle of $Ø_1$ and the second upper edge 157 of the second ramped portion 154 may extend upward from the front surface 121 at an angle of $Ø_2$. The $Ø_1$ and $Ø_2$ may be the same or different and each $Ø_1$ and $Ø_2$ may be selected from an angle ranging from about 10° to about 60°; preferably from about 15° to about 45°; and more preferably about 25° to about 35°.

The wall portion 152 and a transverse line B-B extending between the first and second points 1, 2 of the perimeter edge 124 collectively define a distal-most area 130 of the front surface 121 of the head 120. A remaining portion of the perimeter edge 125 may be free of the wall portion 152. The remaining portion of the perimeter edge 125 may extend from the first point 1 to a sixth point 6 alone the perimeter edge 125. The remaining portion of the perimeter edge 125 may also extend from the second point 2 to a seventh point 7 along the perimeter edge 125. In some embodiments, the wall portion 152 is arcuate and comprises a convex inner surface and a concave outer surface. The wall portion 152 may be free of through-holes.

Referring to FIGS. 5 and 6, the elastomeric component 150 may further comprise a plurality of spaced-apart ridges 158 protruding from an outer surface of the bumper portion 151 and an outer surface of the wall portion 152. The elastomeric component 150 may also comprise a plurality of spaced-apart ridges 158 protruding from an outer surface along at least a portion of the peripheral surface 123. The elastomeric component 150 may further comprise a soft tissue cleanser 180 on the rear surface 122 of the head 120, the soft tissue cleanser 180 comprising a plurality of protuberances 181. In some embodiments, the elastomeric component 150 may be an integrally formed component and include the bumper portion 151, the wall portion 152, the plurality of spaced-apart ridges 158, and the soft tissue cleanser 180.

The soft tissue cleanser 180 is preferably constructed of a biocompatible resilient material suitable for uses in an oral hygiene apparatus, such as a thermoplastic elastomer. As an example, one preferred elastomeric material is styrene-ethylene/butylene-styrene block copolymer (SEBS) manufactured by GLS Corporation. Nevertheless, SEBS material from other manufacturers or other materials. The soft tissue cleanser 180 can be constructed of different types of resilient materials or the same resilient material with one or more different characteristics, such as color, hardness, density, flavor, and/or sensate.

As shown in FIG. 4, the head 120 comprises a base portion 126 formed of a rigid plastic, such as polypropylene. The elastomeric component 150 may be injection molded to the base portion 126. The base portion 126 comprises a peripheral wall 127 that forms a basin 128, the head 120 further comprises a head plate 160 disposed within the basin 128 and coupled to the base portion 126.

The head plate 160 comprises a plurality of through holes 161. A plurality of cleaning elements 140 are provided that extend through the through holes 161 of the head plate. The plurality of cleaning elements 140 extend from the front surface 121 of the head 120.

Each of the plurality of cleaning elements 140 comprise a cleaning portion 141 extending from an upper surface 162 of the head plate 160 for cleaning contact with an oral surface. Each of the plurality of cleaning elements 140 also includes a melt portion 142 located between a lower surface of the head plate 163 and a floor of the basin 129. The melt portions 142 anchor the cleaning elements 140 to the head. While the plurality of cleaning elements 140 are particularly suited for brushing teeth, the plurality of cleaning elements 140 can also be used to clean oral soft tissue, such as a tongue, gums, or cheeks instead of or in addition to teeth.

As used herein, the term "cleaning element" is used in a generic sense to refer to any structure that can be used to clean or massage an oral surface through relative surface contact. Common examples of "cleaning elements" include, without limitation, filament bristles, fiber bristles, nylon bristles, spiral bristles, rubber bristles, elastomeric protrusions, flexible polymer protrusions, combinations thereof and/or structures containing such materials or combinations.

Referring to FIGS. 4-7, the plurality of cleaning elements 140 comprises a plurality of distal cleaning elements 143 extending from the distal-most area 130 of the front surface 121. The maximum height $H_{max}$ of the wall portion 152 is less than or equal to one half of a height $H_{CE}$ of a shortest one of the plurality of distal tooth cleaning elements 143. In one embodiment, the maximum height $H_{max}$ of the wall portion 152 is less than or equal to one third of the height $H_{CE}$ of a shortest one of the plurality of distal tooth cleaning elements 143. In another embodiment, the maximum height $H_{max}$ of the wall portion 152 is less than or equal to one quarter of the height $H_{CE}$ of a shortest one of the plurality of distal tooth cleaning elements 143. The plurality of distal tooth cleaning elements 143 may comprise tapered bristles.

In some embodiments the peripheral surface 123 may comprise the elastomeric component 150 and the rigid plastic used to form the base portion 126 of the head 120. In another embodiment, the peripheral surface 123 may be entirely formed by the elastomeric component 150.

With reference to FIGS. 5-9, the details of the elastomeric component 150 includes the soft tissue cleanser 180, which will now be discussed. The soft tissue cleanser 180 is on the rear surface 122 of the head 120 and comprises a pad 188 that forms at least a portion of the rear surface 122 of the head 120 of the oral care implement 100. The pad 188 is preferably injection molded directly to the head 120 but can be molded separately and later fixed to the head 120 if desired, for example by an adhesive or sonic welding. The pad 188 extends from a distal end 132 of the head 120 to a proximal end 131 of the head 120 and may cover substantially the entire width of the head 120, extending from a first lateral edge 133 of the head 120 towards a second lateral edge 134 of the head 120.

The elastomeric component 150 may have one or more exposed underlying head portions 189 extending therethrough exposing the base portion 126. The exposed underlying head portions 189 may be a variety of geometric shapes—such as circular or crescent shapes. In one embodiment, the exposed underlying head portions 189 define a boundary for which a plurality of protuberances 181 are positioned on the rear surface 122 of the head 120. In one embodiment, crescent shaped exposed underlying head portions 189 define an annular shaped layout of the plurality of protuberances 181 when looking at the rear surface 122 of the head 120.

The pad 188 includes an exposed top surface 190 on the rear surface 122 of the head. The plurality of protuberances 181 protrude from the rear surface 122 of the head 120 from the top surface 190 of the pad 188. The plurality of protuberances 181 may include a first plurality of protuberances 182 arranged in a first annular zone 170 on the rear surface 122. The first annular zone 170 is the area defined between a first dotted line 173 and a second dotted line 174. Each of the first plurality of protuberances 182 may have a height between a first predetermined height $H_1$ and a second predetermined height $H_2$, the second predetermined height $H_2$ being greater than the first predetermined height $H_1$.

The plurality of protuberances 181 may further include a plurality of second protuberances 183 protruding from the rear surface 122 of the head 120 and arranged in a second annular zone 171 on the rear surface 122. The first annular zone 170 surrounds the second annular zone 171. The second annular zone 171 is the area defined between the second dotted line 174 and a third dotted line 175. Each of the second plurality of protuberances 183 may have a height between the second predetermined height $H_2$ and a third predetermined height $H_3$, the third predetermined height $H_3$ being greater than the second predetermined height $H_2$.

The plurality of protuberances 181 may further include a plurality of third protuberances 184 protruding from the rear surface 122 of the head 120 and arranged in a third zone 172 on the rear surface 122. The second annular zone 171 surrounds the third annular zone 173. The third zone 172 may be annular zone or it may be a central zone. The third annular zone 172 is the area defined within the third dotted line 175. Each of the third plurality of protuberances 184 have a height between the third predetermined height $H_3$ and a fourth predetermined height $H_4$, the fourth predetermined height $H_4$ being greater than the third predetermined height $H_3$.

In some embodiments, the plurality of first protuberances 182 may comprise protuberances having a plurality of different heights between the first and second predetermined heights $H_1$, $H_2$. The plurality of second protuberances 183 may comprise protuberances having a plurality of different heights between the second and third predetermined heights $H_2$, $H_3$. The plurality of third protuberances 184 may comprises protuberances having a plurality of different heights between the third and fourth predetermined heights $H_3$, $H_4$.

In certain embodiments, the plurality of first protuberances 182 consist only of protuberances having a height between the first and second predetermined heights $H_1$, $H_2$. The plurality of second protuberances 183 consist only of protuberances having a height between the second and third predetermined heights $H_2$, $H_3$. The plurality of third protuberances 184 consist only of protuberances having a height between the third and fourth predetermined heights $H_3$, $H_4$.

The first predetermined height $H_1$ may be in a range of 0.5 mm to 1.5 mm, the second predetermined height $H_2$ may be in a range of 1.5 mm to 2.5 mm, the third predetermined height $H_3$ may be in a range of 2.5 mm to 3.5 mm, and the fourth predetermined height $H_4$ may be in a range of 3.5 mm to 6.0 mm.

In some embodiments, free ends of the first, second and third protuberances 182, 183, 184 collectively form a convex side profile (see FIGS. 5 and 6). In some embodiments, the free ends of the first, second and third protuberances 182, 183, 184 may also collectively form a convex top profile (see FIG. 7).

The plurality of first protuberances 182 comprises first conical nubs, the plurality of second protuberances 183 comprises second conical nubs, and the plurality of third protuberances 184 comprises third conical nubs. In one embodiment, the plurality of first protuberances 182 consists only of the first conical nubs, the plurality of second protuberances 183 consists only of second conical nubs, and the plurality of third protuberances 184 consists only of the third conical nubs. The plurality of conical nubs extends from the pad portion 188.

As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

The first, second, and third plurality of nubs 182-184 are designed to engage the oral soft tissue to significantly reduce a major source of bad breath in people and improve hygiene. The first, second, and third plurality of nubs 182-184 enable removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise pulled against a tongue surface, for example, the first, second, and third nubs provide for gentle engagement with the soft tissue while reaching downward into the recesses of adjacent papillae of the tongue. The elastomeric construction of the soft tissue cleanser 180 also enables a top surface 190 of the pad 188 to follow the natural contours of the oral tissue surfaces, such as the tongue, cheeks, lips, and gums of a user. Moreover, the first, second, and third nubs are able to flex as needed to traverse and clean the soft tissue surfaces in the mouth along which it is moved.

In the illustrated embodiment, the first, second, and third nubs are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. The base portion of each the conically shaped first, second, and third nubs 182-184 is larger than the corresponding tip portion.

Furthermore, the resilient material of the first, second, and/or third annular zones 170, 171, 172 may also be imbued with a sensory material, which can be any suitable biocompatible medication or chemical for oral use. The sensory material is released inside the mouth, lips, or cheeks by way of several methods, including but not limited to abrasion, a temperature change, a change in pH or dissolution. In one embodiment, the sensory material is a sensate that provides a biochemical sensory response to the inside tissue and surfaces of the mouth. Such a sensory response is understood to result from stimulation of the trigeminal nerve of a human. A sensate generally produces a physiological effect without a taste, with such effect usually represented by the terms cooling, tingle, and hot (or heat). Sensates are usually derived from single compounds that are not volatile and that do not have a smell or taste per se. As one example, a chemical known as capsaicin, found naturally in chile peppers, can be used to provide a tingle, a hot or warm massage, or a heating or warm, soothing sensation to a user. Capsaicin is also known to provide pain relief and numbing sensations when topically applied. Some examples of sensates that produce cooling sensations include (−)-menthol and camphor. Most of the polyols, including maltitol syrup, sorbitol, mannitol, erythritol, isomalt and xylitol, also provide a cooling sensation. The coolest of the polyols, erythritol, provides a distinct cooling sensation. Both erythritol and xylitol cool the mouth and fight the sensation of dry mouth commonly associated with prescription drugs and dental hygiene products. Erythritol is a naturally occurring four-carbon structure. Xylitol is a five-carbon sugar found in fruits and vegetables and made in small amounts by the human system as a metabolic intermediate.

In another embodiment, the sensory material is provided as flavoring agent for causing an olfactory sensory response in a human. A flavor agent is commonly understood to include a mixture of compounds that are volatile and produce an aromatic effect and that stimulate the olfactory bulb. Flavors are generally transmitted through the nasal passages, and are often selected and used for their unique association with certain consumer benefits, such as lavender for stress relief or relaxation. Another flavor example is chamomile, which has a strong, aromatic smell and is often used medicinally against sore stomach and as a relaxant to help you fall asleep. Chamomile is also used as a mouthwash against oral mucositis (the swelling, irritation, and ulceration of the mucosal cells that line the digestive tract).

In one embodiment, the first, second, and/or third annular zone 170, 171, 172 can be imbued with both a sensate component and a flavor component. The soft tissue cleanser 180 may be an integrally formed singular component.

Figure 7:
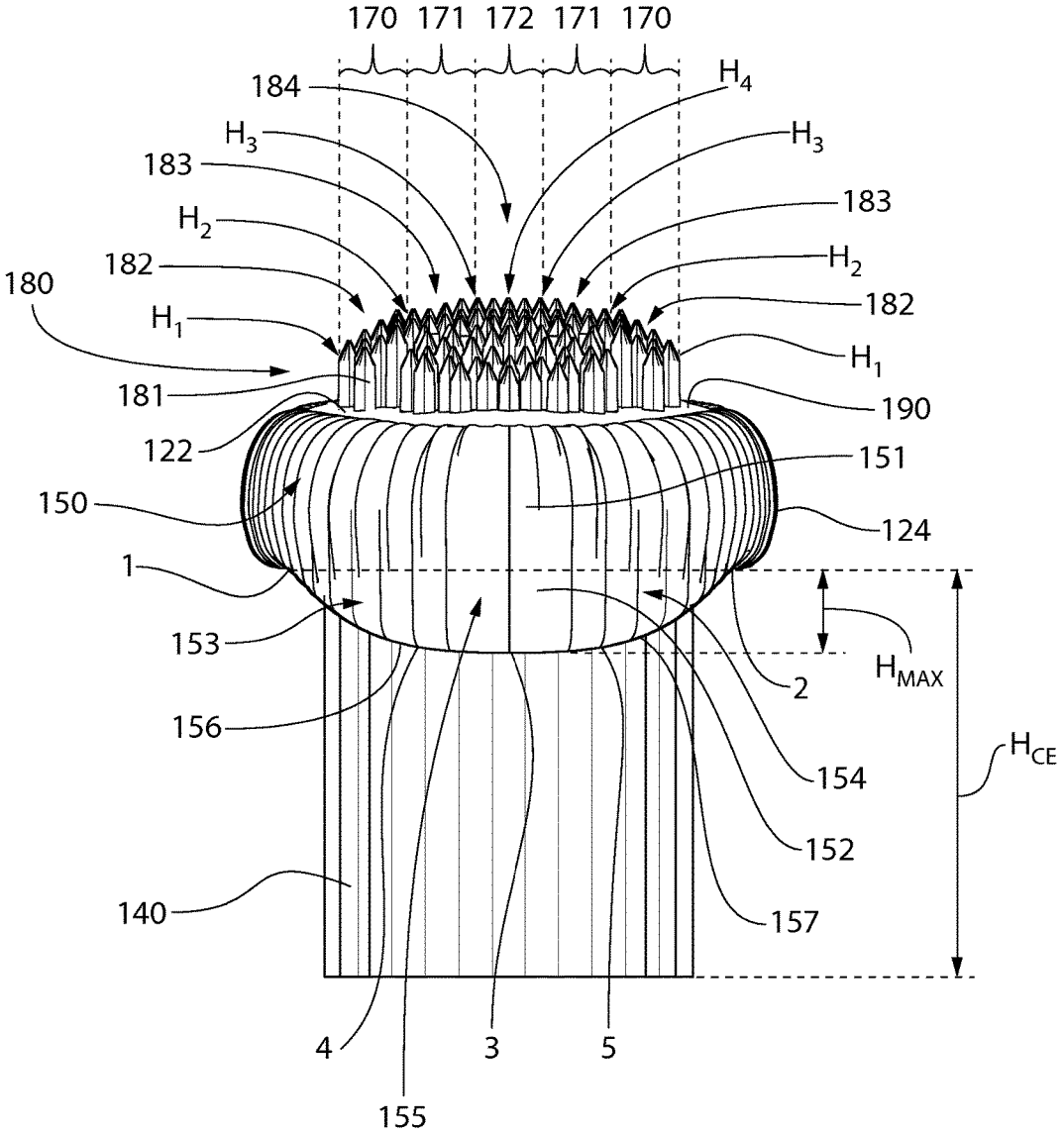
FIG. 7 is an enlarged top view of the head of the oral care implement of FIG. 1.
Figure 8:
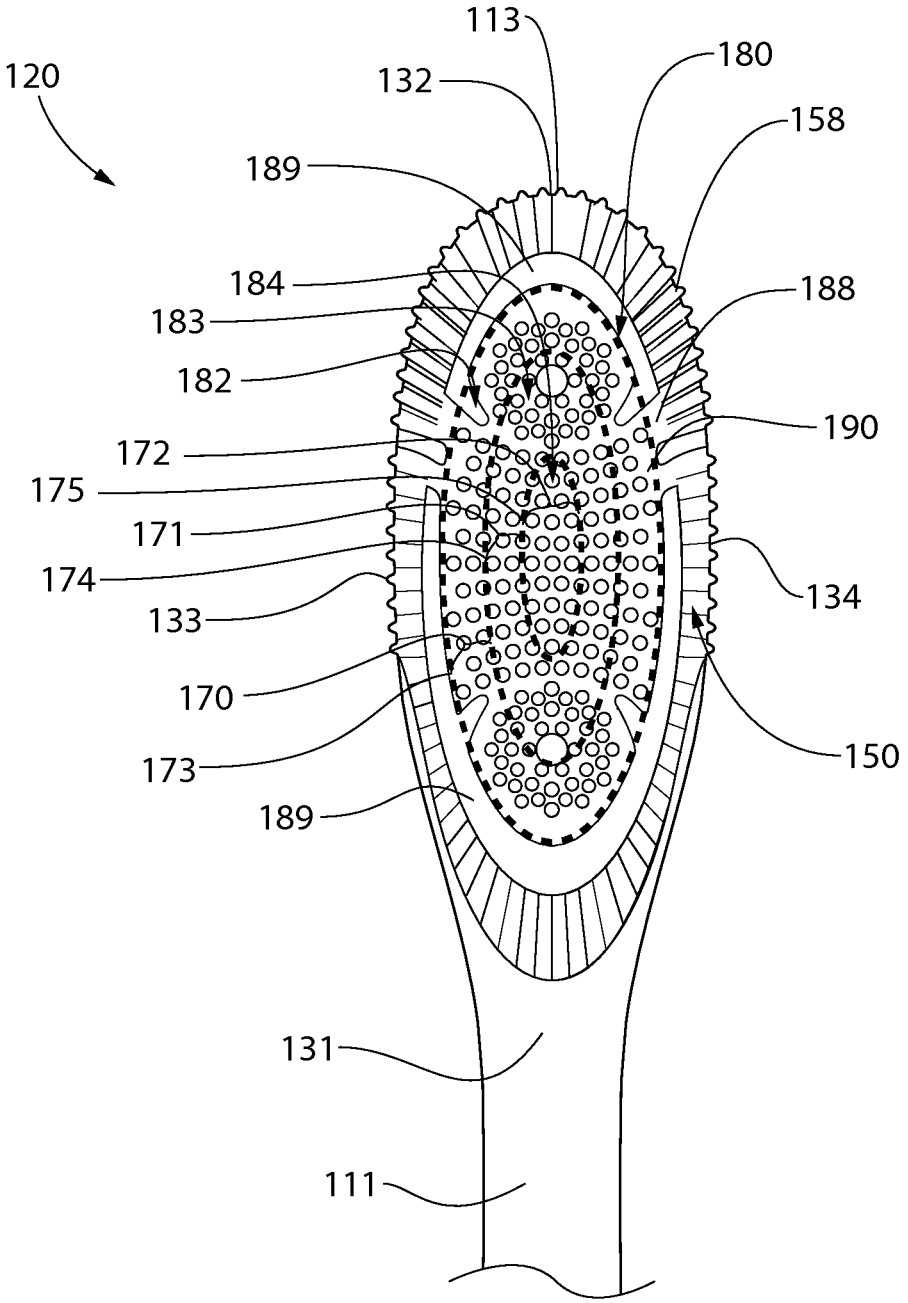
FIG. 8 is a rear view of the head of the oral care implement of FIG. 1.
Figure 9:
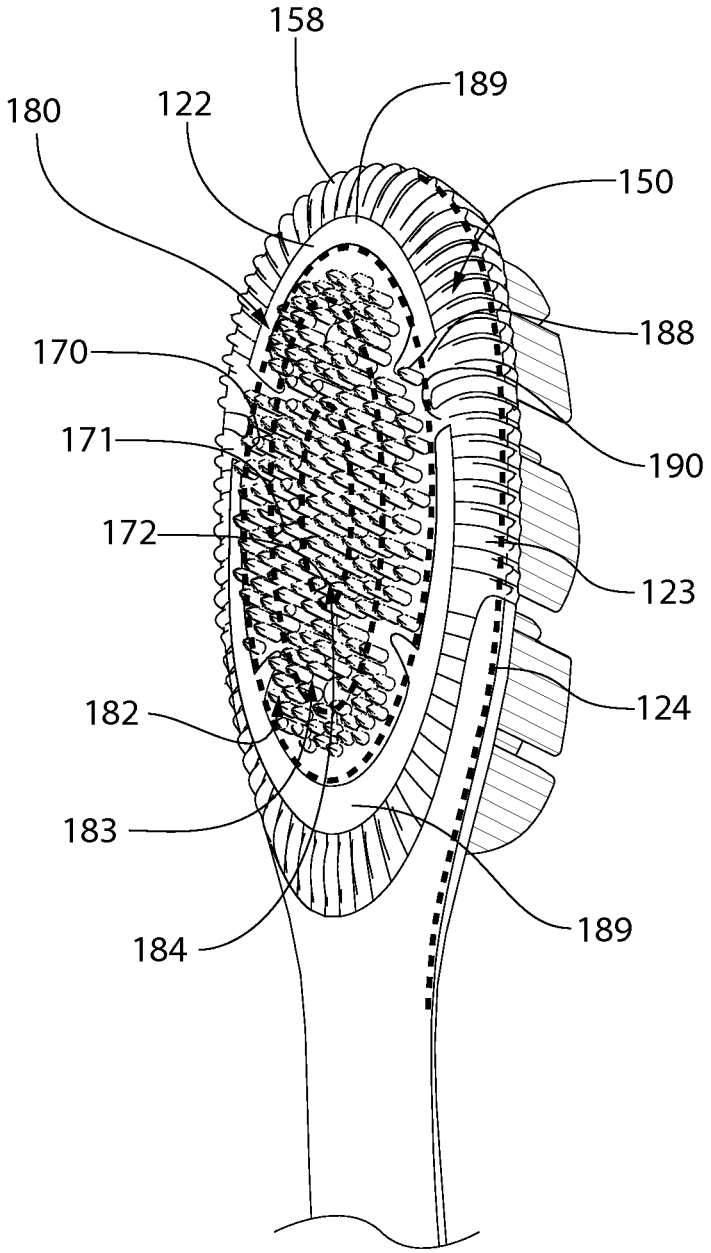
FIG. 9 is a rear perspective view of the head of the oral care implement of FIG. 1.

Referring now to FIGS. 6-8 concurrently, one preferred embodiment of manufacturing the head 120 via an injection molding process will be described. First, the head 120 is formed by injecting a liquefied hard plastic, such as PP or SAN, into a mold having the appropriately shaped fill cavity. Once the head 120 is sufficiently cooled (the structure of which is described above), an outer mold is placed about the head 120 for forming the elastomeric component 150. The elastomeric component 150 is formed by an overmolding process which involves injecting a single shot of a first type of liquefied thermoplastic elastomer about the head 122 via a first port having a first size. The first type of liquefied thermoplastic elastomer surrounds the head 120 and fills available gaps/grooves on the head 120. As a result, the elastomeric component 150 is formed as illustrated. The elastomeric component 150 may also be made using separate shots, each using different types of thermoplastic elastomer, to form different components of the elastomeric component 150—for example one shot for the pad 188 and another shot for the plurality of protuberances 181. This allows the pad 188 and the plurality of protuberances 181 to be formed of different types of elastomers, which may be useful for elastomeric components 150 having differing colors, flavors, sensates or material properties, such as hardness or density.

Another embodiment of manufacturing the head 120 includes the head plate 160 which clusters of the plurality of cleaning elements 140 are inserted through the through holes 161. The rear ends of the plurality of cleaning elements 140 are melted thereby affixing the plurality of cleaning elements 140 to the head plate 160. The melted portions form the melt portion 142 that adheres to the head plate 160 and bonds the plurality of cleaning elements 140 to each other.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle; and a head extending along a longitudinal axis from a proximal end to a distal end, the head comprising:

a front surface;

a rear surface opposite the front surface;

a peripheral surface extending between the front and rear surfaces and defining a perimeter edge of the front surface;

a plurality of tooth cleaning elements extending from the front surface;

an elastomeric component including a bumper portion that forms a distal-most section of the peripheral surface and a wall portion located along a distal-most section of the perimeter edge and protruding above the front surface;

the wall portion extending along the perimeter edge in a continuous manner from a first point of the perimeter edge to a second point of the perimeter edge, the first and second points located on opposite sides of the longitudinal axis; and the wall portion comprises a first ramped portion, an apex portion, and a second ramped portion, the apex portion disposed between the first and second ramped portions; and wherein the wall portion has a maximum height at a third point of the perimeter edge located between the first and second points, the third point located on the longitudinal axis and on the apex portion.

2. The oral care implement according to claim 1 further comprising:

the first ramped portion extending from the first point to a fourth point of the perimeter edge, the fourth point located between the first and third points, the height of the first ramped portion of the wall portion increasing from the first point to the fourth point; and the second ramped portion extending from the second point to a fifth point of the perimeter edge, the fifth point located between the second and third points, the height of the second ramped portion of the wall portion increasing from the second point to the fifth point.

3. The oral care implement according to claim 2 further comprising:

the apex portion extending from the fourth point to the fifth point, the apex portion having a substantially constant height from the fourth point to the fifth point.

4. The oral care implement according to claim 1 further comprising:

the first ramped portion extending from the first point to the third point, the height of the first ramped portion of the wall portion increasing from the first point to the third point; and the second ramped portion extending from the second point to the third point, the height of the second ramped portion of the wall portion increasing from the second point to the third point.

5. The oral care implement according to claim 1 wherein a remaining portion of the perimeter edge is free of the wall portion.

6. The oral care implement according to claim 1 wherein the wall portion is free of through-holes.

7. The oral care implement according to claim 1 wherein elastomeric component further comprises a plurality of spaced-apart ridges protruding from an outer surface of the bumper portion and an outer surface of the wall portion.

8. The oral care implement according to claim 1 wherein the elastomeric component further comprises a soft tissue cleanser on the rear surface of the head, the soft tissue cleanser comprising a plurality of protuberances.

9. The oral care implement according to claim 1 wherein the wall portion and a transverse line drawn between the first and second points of the perimeter edge collectively define a distal-most area of the front surface of the head; and wherein the plurality of tooth cleaning elements comprises a plurality of distal tooth cleaning elements extending from the distal-most area of the front surface, and wherein the wall portion has a maximum height that is less than or equal to one half of a height of a shortest one of the plurality of distal tooth cleaning elements.

10. An oral care implement comprising:

a handle; and a head extending along a longitudinal axis from a proximal end to a distal end, the head comprising:

a front surface;

a rear surface;

a plurality of tooth cleaning elements extending from the front surface; and a soft tissue cleanser on the rear surface of the head;

the soft tissue cleanser comprising:

a plurality of first protuberances protruding from the rear surface of the head and arranged in a first annular zone on the rear surface, each of the first plurality of protuberances having a height measured from the rear surface of the head to a free end of each of the first plurality of protuberances having a height between a first predetermined height and a second predetermined height, the second predetermined height being greater than the first predetermined height;

a plurality of second protuberances protruding from the rear surface of the head and arranged in a second annular zone on the rear surface, the first annular zone surrounding the second annular zone, each of the second plurality of protuberances having a height measured from the rear surface of the head to a free end of each of the second plurality of protuberances, the height between the second predetermined height and a third predetermined height, the third predetermined height being greater than the second predetermined height; and a plurality of third protuberances protruding from the rear surface of the head and arranged in a third zone on the rear surface, the second annular zone surrounding the third zone, each of the third plurality of protuberances having a height measured from the rear surface of the head to a free end of each of the third plurality of protuberances, the height between the third predetermined height and a fourth predetermined height, the fourth predetermined height being greater than the third predetermined height.

11. The oral care implement according to claim 10 wherein the free ends of the first, second and third plurality of protuberances collectively form a convex side profile and a convex top profile.

12. The oral care implement according to claim 10 wherein the plurality of first protuberances comprise first conical nubs, the plurality of second protuberances comprise second conical nubs, and the plurality of third protuberances comprise third conical nubs.

13. The oral care implement according to claim 10 wherein the plurality of first protuberances comprise protuberances having a plurality of different heights between the first and second predetermined heights; wherein the plurality of second protuberances comprise protuberances having a plurality of different heights between the second and third predetermined heights; and wherein the plurality of third protuberances comprise protuberances having a plurality of different heights between the third and fourth predetermined heights.

14. The oral care implement according to claim 10 wherein the first predetermined height is in a range 0.5 to 1.5 mm, the second predetermined height is in a range of 1.0 mm to 2.5 mm, the third predetermined height is in a range of 2.5 mm to 3.5 mm, and the fourth predetermined height is in a range of 3.5 mm to 6.0 mm.

15. The oral care implement according to claim 10 wherein the soft tissue cleanser on the rear surface of the head comprises a pad portion that forms at least a portion of the rear surface of the head, the first, second and third pluralities of protuberances extending from the pad portion.

16. The oral care implement according to claim 10 wherein the soft tissue cleanser is an integrally formed singular component.

17. An oral care implement comprising:

a handle; and a head extending along a longitudinal axis from a proximal end to a distal end, the head comprising:

a front surface;

a rear surface;

a plurality of tooth cleaning elements extending from the front surface; and a soft tissue cleanser on the rear surface of the head;

the soft tissue cleanser comprising:

a plurality of cylindrical nubs protruding from the rear surface of the head and having a height measured from the rear surface of the head;

wherein the heights of the plurality of cylindrical nubs vary such that free ends of the plurality of cylindrical nubs collectively form a convex side profile and a convex top profile.

18. The oral care implement according to claim 17 wherein the plurality of cylindrical nubs comprises cylindrical nubs having a height greater than or equal to 3.5 mm.

19. The oral care implement according to claim 17 wherein the soft tissue cleanser comprises a pad portion that forms at least a portion of the rear surface of the head, the plurality of cylindrical nubs extending from the pad portion.

* * * * *